US007383823B2

(12) United States Patent
Becker

(10) Patent No.: US 7,383,823 B2
(45) Date of Patent: Jun. 10, 2008

(54) FUEL INJECTION SYSTEM FOR AN INTERNAL COMBUSTION ENGINE

(75) Inventor: Thomas Becker, Esslingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/593,327

(22) PCT Filed: Jan. 17, 2005

(86) PCT No.: PCT/EP2005/050175

§ 371 (c)(1),
(2), (4) Date: Sep. 18, 2006

(87) PCT Pub. No.: WO2005/090774

PCT Pub. Date: Sep. 29, 2005

(65) Prior Publication Data

US 2007/0209638 A1 Sep. 13, 2007

(30) Foreign Application Priority Data

Mar. 18, 2004 (DE) ..... 10 2004 013 248

(51) Int. Cl.
*F02M 37/08* (2006.01)
*F02M 37/00* (2006.01)

(52) U.S. Cl. ..... 123/514; 123/456

(58) Field of Classification Search ..... 123/456, 123/514, 458, 445, 457, 446, 468, 469, 506
See application file for complete search history.

(56) References Cited

U.S. PATENT DOCUMENTS 4,478,197 A * 10/1984 Yasuhara et al. ..... 123/514
5,878,718 A 3/1999 Rembold et al.
5,911,208 A * 6/1999 Furusawa et al. ..... 123/506
6,131,548 A * 10/2000 Yano ..... 123/456
6,230,684 B1 5/2001 Furuhashi et al.
6,446,612 B1 * 9/2002 Hankins et al. ..... 123/514
6,752,130 B2 * 6/2004 Schueler et al. ..... 123/514
6,823,846 B2 * 11/2004 Mattes ..... 123/456
7,007,670 B2 * 3/2006 Okamoto et al. ..... 123/446
2003/0111052 A1 * 6/2003 Schueler et al. ..... 123/446
2004/0016421 A1 * 1/2004 Mattes ..... 123/502
2004/0069278 A1 * 4/2004 Okamoto et al. ..... 123/458
2005/0092302 A1 * 5/2005 Kojima ..... 123/458

* cited by examiner

*Primary Examiner*—Mahmoud Gimie
(74) *Attorney, Agent, or Firm*—Ronald E. Greigg

(57) ABSTRACT

A fuel injection system having a high-pressure side which includes at least one high-pressure reservoir, in which fuel is stored at injection pressure, and at least one injector communicating with the high-pressure reservoir for fuel injection at a cylinder of the engine. The fuel injection system moreover has a low-pressure side which communicates at least indirectly with a fuel tank. The high-pressure side has a communication with the low-pressure side, which communication is controlled as a function of the fuel temperature in the high-pressure side and at a high fuel temperature is at least substantially closed, so that the high-pressure side is disconnected from the low-pressure side, and that is open at a low fuel temperature.

9 Claims, 2 Drawing Sheets

FUEL INJECTION SYSTEM FOR AN INTERNAL COMBUSTION ENGINE

CROSS-REFERENCE TO RELATED APPLICATIONS

This application is a 35 USC 371 application of PCT/EP 2005/050175 filed on Jan. 17, 2005.

BACKGROUND OF THE INVENTION

1. Field of the Invention

The invention is directed to an improved fuel injection system for an internal combustion engine.

2. Description of the Prior Art

One known fuel injection system known from the literature, such as Dieselmotor-Management [Diesel Engine Management], published by Verlag Vieweg, 2nd Ed. 1998, pages 280 to 284 has a high-pressure side, which includes a high-pressure reservoir and injectors communicating with it for fuel injection at a cylinder of the engine. The high-pressure side furthermore includes a high-pressure pump, by which fuel is pumped into the high-pressure reservoir. The fuel injection system also has a low-pressure side, which communicates at least indirectly with a fuel tank. The low-pressure side may be the fuel tank, a return to the fuel tank, or a supply communication by way of which the intake side of the high-pressure pump is supplied with fuel from the fuel tank. A low-pressure pump, by which fuel from the fuel tank is delivered to the intake side of the high-pressure pump, may be disposed in the supply communication. The high-pressure side is separate from the low-pressure side, to avoid fuel leakage. During engine operation, the fuel warms up, especially in the high-pressure side of the fuel injection system. If the engine is shut down after a relatively long period of operation, the fuel in the high-pressure side cools down, thus decreasing in volume, which can lead to the formation of vapor bubbles in the high-pressure side. As a result, the later re-starting of the engine is more difficult, because first the vapor bubbles in the high-pressure side must be positively displaced, before a fuel injection and hence combustion in the engine can begin.

SUMMARY AND ADVANTAGES OF THE INVENTION

The fuel injection system according to the invention has the advantage over the prior art that vapor bubble formation upon cooling down of the fuel in the high-pressure side is avoided, since fuel from the low-pressure side can flow into the high-pressure side to compensate for the reduction in volume, and reliable starting of the engine is thus made possible. At a high fuel temperature, there is no leakage or at most only very slight leakage, so that a substantially increased quantity of fuel need not be fed into the high-pressure side.

Advantageous features and refinements of the fuel injection system of the invention are disclosed. One embodiment makes simple temperature-dependent control of the communication of the high-pressure side with the low-pressure side possible. Another embodiment makes a simple embodiment of the valve device possible. In a further embodiment, a long sealing gap is present, so that at a high fuel temperature, the communication with the low-pressure side is reliably closed, and there is no leakage or only slight leakage. A space-saving arrangement of the valve device is possible without major added engineering expense.

BRIEF DESCRIPTION OF THE DRAWINGS

Other features and advantages of the invention will become apparent from the description contained herein below, taken in conjunction with the drawings, in which.

DESCRIPTION OF THE PREFERRED EMBODIMENT

Figure 1:
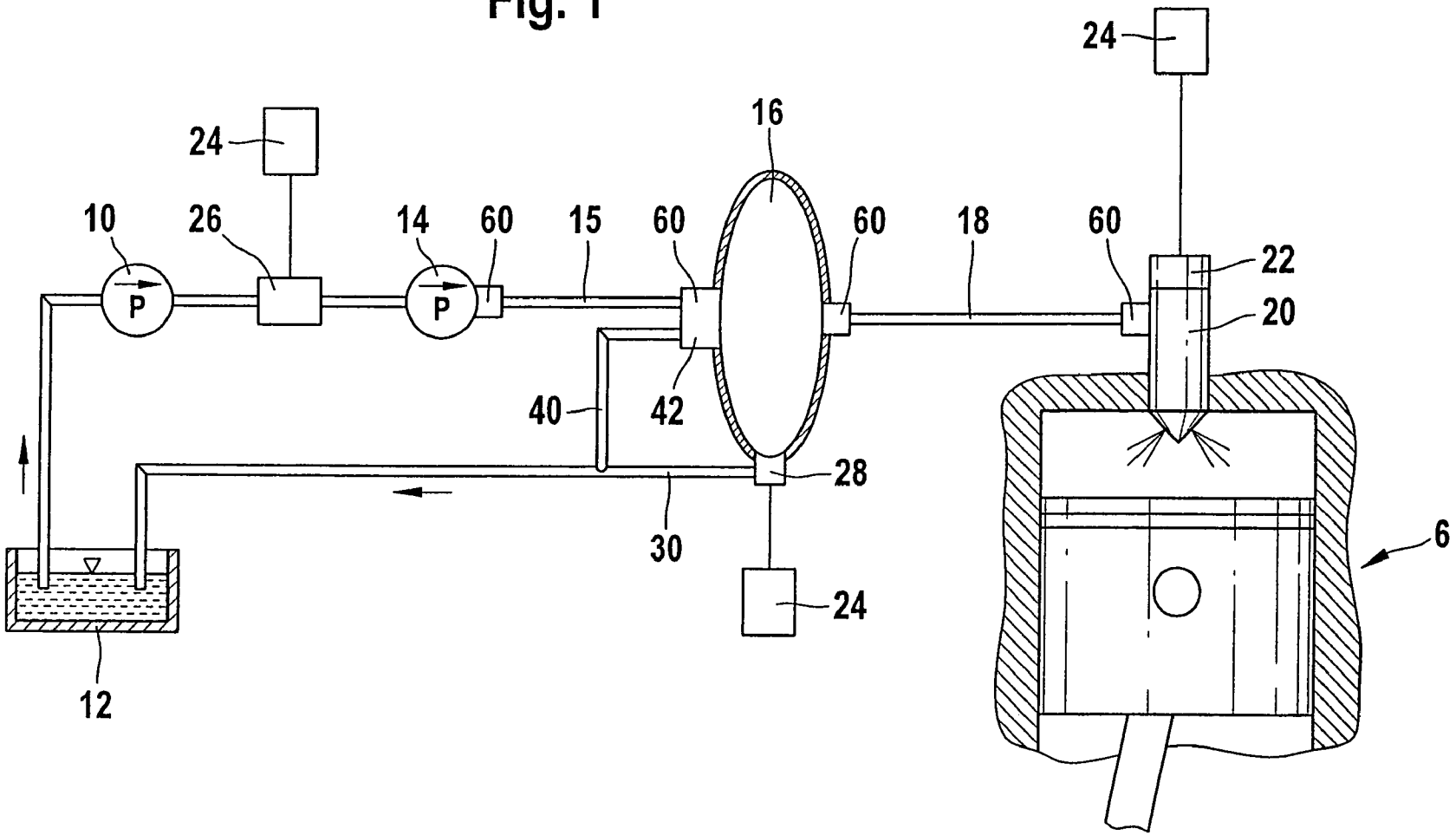
FIG. 1 schematically shows a fuel injection system for an internal combustion engine.

In FIG. 1, a fuel injection system for an internal combustion engine of a motor vehicle is shown. The engine is preferably a self-ignition engine and has one or more cylinders 6, only one of which is shown in FIG. 1. The fuel injection system has a feed pump 10, by which fuel from a tank 12 is pumped to a high-pressure pump 14. By means of the high-pressure pump 14, fuel is pumped at high pressure, via at least one hydraulic line 15, into a high-pressure reservoir 16. Via hydraulic lines 18, injectors 20 located at the cylinders 6 of the engine communicate with the high-pressure reservoir 16. At each injector 20 there is a respective control valve 22, by means of which the injector 20 can be opened for a fuel injection or closed to terminate a fuel injection. The control valves 22 of the injectors 20 are connected to an electronic control unit 24 and are triggered by it as a function of engine operating parameters. The control valves 22 may each have an electromagnetic or piezoelectric actuator.

The fuel injection system has a high-pressure side, which includes the compression side of the high-pressure pump 14, the line 15 between the high-pressure pump 14 and the high-pressure reservoir 16, the high-pressure reservoir 16, the lines 18 from the high-pressure reservoir 16 to the injectors 20, and the injectors 20. In the high-pressure side, the high pressure generated by the high-pressure pump 14 prevails and can amount to between 1200 and 2000 bar, for example. The high pressure can be variably adjusted as a function of engine operating parameters by means of a fuel metering device 26, located between the feed pump 10 and the intake side of the high-pressure pump 14, and/or by means of a pressure regulating valve 28, located in the high-pressure side. The fuel metering device 26 is triggered by the control unit 24 as a function of the pressure required in the high-pressure side. The pressure regulating valve 28 may be triggered by the control unit 24, and from it a return 30, by way of which fuel can be diverted from the high-pressure side, leads to the tank 12. The fuel injection system furthermore has a low-pressure side, which includes the tank 12, the communication between the tank 12 and the intake side of the high-pressure pump 14, with the feed pump 10 located in it, and the return 30 from the pressure regulating valve 28 to the tank 12. In the low-pressure side, at least approximately ambient pressure prevails, or the pressure generated by the feed pump 10, which may for instance amount to about 2 to 10 bar.

According to the invention, it is provided that the high-pressure side has a communication 40 with the low-pressure side, which communication is controlled as a function of the fuel temperature in the high-pressure side and is at least substantially closed at a high fuel temperature, so that the high-pressure side is disconnected from the low-pressure side, and is open at a low fuel temperature. The communication 40 is controlled by a valve device 42, which is influenced by the fuel temperature in the high-pressure side.

Figure 2:
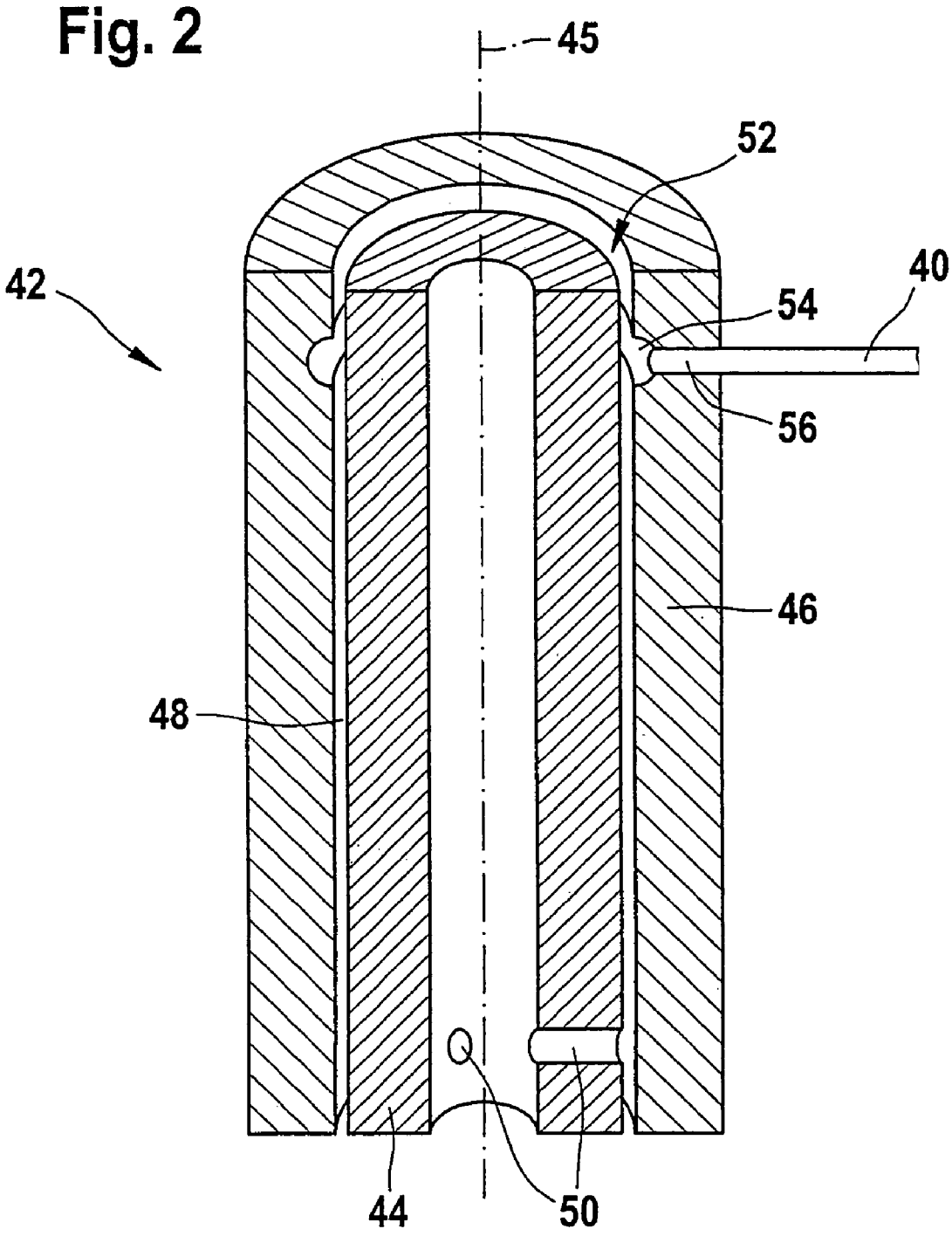
FIG. 2 shows a valve device of the fuel injection system of FIG. 1 enlarged and in section.

The valve device 42 will now be described in further detail in conjunction with FIG. 2. The valve device 42 has a bimetal switching device, which has two elements 44, 46 of metals with different, preferably highly different coefficients of thermal expansion. When the fuel temperature varies, the element 44 having the greater coefficient of thermal expansion deforms more than the element 46 having the lesser coefficient of thermal expansion, and as a result the communication 40 can be opened and closed. The element 44 having the greater coefficient of thermal expansion may be made from aluminum, for instance, and the element 46 having the lesser coefficient of thermal expansion may be made from steel, for instance.

The elements 44, 46 are each embodied in sleevelike form; the element 44 having the greater coefficient of thermal expansion is disposed inside other element 46, which has the lesser coefficient of thermal expansion. At a low fuel temperature, between the two elements there is a flow cross section in the form of an annular conduit 48, which at a high fuel temperature is at least substantially closed, because of the greater expansion of the inner element 44 relative to the outer element 46. The inner element 44 is filled with fuel from the high-pressure side. The annular conduit 48 communicates with the high-pressure side via at least one opening 50, for instance in the form of a bore, in the inner element 44. The communication between the annular conduit 48 and the high-pressure side in the interior of the inner element 44 may also be formed by a groove or a gap between a face end of the element 44 and a boundary diametrically opposite it. The annular conduit 48 also communicates with the low-pressure side via at least one transition region 52 in the outer element 46. In the transition region 52, in the inner jacket of the outer element 46, an annular groove 54 may be made, which is in communication with the low-pressure side, for instance via at least one bore 56, opening into the annular groove 54, in the outer element 46 or via a longitudinal groove which leads away from the annular groove 54 and to which a line forming the communication 40 with the low-pressure side is connected. The at least one opening 50, as the communication of the annular conduit 48 with the high-pressure side, and the transition region 52, as the communication of the annular conduit 48 with the low-pressure side, are preferably located at a distance from one another in the direction of the longitudinal axis 45 of the elements 44, 46. As a result of this arrangement, the annular conduit 48 and thus the sealing gap, formed at a high fuel temperature by the closure of the annular conduit 48, have a great length, as a result of which good sealing and hence only slight leakage at a high fuel temperature are attained.

The valve device 42 described above may be disposed at an arbitrary point in the high-pressure side of the fuel injection system, for instance at the high-pressure reservoir 16, in the line 15 between the high-pressure pump 14 and the high-pressure reservoir 16, in one of the lines 18 between the high-pressure reservoir 16 and an injector 20, at an injector 20, or at a connection element 60 of one of the lines 15, 18 at one of the components. Preferably, the valve device 42 is integrated with one of these components, or as shown in FIG. 1 is integrated with a connection element 60; the outer element 46 is formed by the component, a housing part of the component, or the connection element 60. Thus the only additional components needed for the valve device 42 are the inner element 44 and the line 40. The connection element 60 may for instance be a connection stub or a union nut for connecting a line 15 or 18 to one of the components of the high-pressure side.

At a low fuel temperature, when the annular conduit 48 is open, the inner element 44 is subjected on both its inside and its outside to at least approximately the same pressure, so that no substantial deformation of the inner element 44 is caused by the pressure. If when the fuel temperature is rising the size of the annular conduit 48 is reduced because of the expansion of the inner element 44, the result in addition, because of what is then reduced pressure, acting on the outside of the inner element 44, in the annular conduit 48 because of the throttling that occurs, is an expansion of the inner element 44 because of the high pressure acting on the inside of the element 44, and thus a reinforcement upon closure of the annular conduit 48.

Because of the valve device 42, the high-pressure side has variable leakage, but by appropriate triggering of the fuel metering device 26 and/or of the pressure regulating valve 28, this can be compensated for by control unit 24. In the design of the valve device 42, depending on the installation location, further factors may also have to be taken into account, such as heating of the valve device 42 caused by heat radiated by or transferred from the engine.

The foregoing relates to a preferred exemplary embodiment of the invention, it being understood that other variants and embodiments thereof are possible within the spirit and scope of the invention, the latter being defined by the appended claims.

The invention claimed is:

1. A fuel injection system for an internal combustion engine, the system comprising:

a high-pressure side including at least one high-pressure reservoir in which fuel is stored at injection pressure and at least one injector; communicating with the high-pressure reservoir, for fuel injection to a cylinder of the engine;

a low-pressure side which communicates at least indirectly with a fuel tank;

a communication between the high-pressure side and the low-pressure side, which communication is controlled as a function of the fuel temperature in the high-pressure side, the communication being at least substantially closed at a high fuel temperature so that the high-pressure side is disconnected from the low-pressure side, and the communication being open at a low fuel temperature; and a valve device controlling the communication of the high-pressure side with the low-pressure side, wherein the valve device is disposed in a component in the high-pressure side, such that an inlet of the valve device is at high pressure.

2. The fuel injection system as defined by claim 1, wherein the valve device comprises a bimetal switching device having at least two elements that comprise metals of different coefficients of thermal expansion.

3. The fuel injection system as defined by claim 2, wherein a flow section is opened between the two elements at a low fuel temperature; and wherein at a high fuel temperature, the flow cross section is at least substantially closed by the element having the greater coefficient of thermal expansion.

4. A fuel injection system for an internal combustion engine, the system comprising:

a high-pressure side including at least one high-pressure reservoir in which fuel is stored at injection pressure and at least one injector communicating with the high-pressure reservoir, for fuel injection to a cylinder of the engine;

a low-pressure side which communicates at least indirectly with a fuel tank;

a communication between the high-pressure side and the low-pressure side, which communication is controlled as a function of the fuel temperature in the high-pressure side, the communication is at least substantially closed a high fuel temperature so that the high-pressure side is disconnected from the low-pressure side, and the communication is open at a low fuel temperature; and a valve device controlling the communication of the high-pressure side with the low-pressure side, which valve device is influenced by the fuel temperature in the high-pressure side, wherein the valve device comprises a bimetal switching device having at least two elements that comprise metals of different coefficients of thermal expansion, wherein a flow section is opened between the two elements at a low fuel temperature, wherein at a high fuel temperature, the flow cross section is at least substantially closed by the element having the greater coefficient of thermal expansion, wherein the elements are embodied in sleevelike form, wherein the element having the greater coefficient of thermal expansion is disposed inside the other element, wherein the inner element is filled in its interior with fuel from the high-pressure side, and wherein the openable flow cross section is embodied as an annular conduit between the elements.

5. The fuel injection system as defined by claim 4, further comprising a first communication from the high-pressure side opening into annular conduit, and a second communication from the low-pressure side opening into the annular conduit, the orifices of the first and second communications being from one another in the direction of the longitudinal axis of the elements.

6. The fuel injection system as defined by claim 4, wherein the valve device is disposed in a component in the high-pressure side, preferably in a housing part, a line, or a connection element of a line.

7. The fuel injection system as defined by claim 5, wherein the valve device is disposed in a component in the high-pressure side, preferably in a housing part, a line, or a connection element of a line.

8. The fuel injection system as defined by claim 4, wherein the valve device is disposed in a component in the high-pressure side, preferably in a housing part, a line, or a connection element of a line, and wherein the outer element is formed by the housing part, the line or the connection element.

9. The fuel injection system as defined by claim 5, wherein the valve device is disposed in a component in the high-pressure side, preferably in a housing part, a line, or a connection element of a line, and wherein the outer element is formed by the housing part, the line, or the connecting element.

* * * * *